US011262703B2

(12) United States Patent
Silvant

(10) Patent No.: US 11,262,703 B2
(45) Date of Patent: Mar. 1, 2022

(54) ANNULAR ROTATING BEZEL SYSTEM COMPRISING AT LEAST ONE ELASTIC ARM

(71) Applicant: OMEGA SA, Biel/Bienne (CH)

(72) Inventor: Olivier Silvant, Macolin (CH)

(73) Assignee: OMEGA SA, Biel/Bienne (CH)

( * ) Notice: Subject to any disclaimer, the term of this patent is extended or adjusted under 35 U.S.C. 154(b) by 428 days.

(21) Appl. No.: 16/290,994

(22) Filed: Mar. 4, 2019

(65) Prior Publication Data

US 2019/0294113 A1 Sep. 26, 2019

(30) Foreign Application Priority Data

Mar. 20, 2018 (EP) ..... EP18162720

(51) Int. Cl.
*G04B 19/28* (2006.01)

(52) U.S. Cl.
CPC ..... *G04B 19/283* (2013.01)

(58) Field of Classification Search
CPC .... G04B 19/283; G04B 19/286; G04B 37/00; G04B 37/08; G04B 37/0008
USPC ..... 368/294–296
See application file for complete search history.

(56) References Cited

U.S. PATENT DOCUMENTS 5,319,617 A * 6/1994 Sonoda ..... G04B 19/286 368/294
5,541,895 A 7/1996 Nussbaum
9,348,315 B2 * 5/2016 Cattaneo ..... G04B 19/223
2003/0123332 A1 * 7/2003 Hiranuma ..... G04B 19/286 368/295
2015/0185702 A1 7/2015 Silvant

FOREIGN PATENT DOCUMENTS

CH 706 597 A2 12/2013
CN 104412176 A 3/2015
CN 2015-518967 A 7/2015
(Continued)

OTHER PUBLICATIONS

European Search Report dated Sep. 26, 2018 in European Application No. 18162720.9, filed on Mar. 20, 2018 (with English Translation of Categories of Cited Documents).
(Continued)

*Primary Examiner* — Edwin A. Leon
(74) *Attorney, Agent, or Firm* — Oblon, McClelland, Maier & Neustadt, L.L.P.

(57) ABSTRACT

An annular rotating bezel system intended to be rotatably mounted on a middle part of a watch case inside which is housed a timepiece movement which extends in a plane, including a rotating bezel, an annular holding ring, a toothed ring, and at least one elastic arm of which a free end is elastically and radially meshed with the toothed ring, said toothed ring and said at least one elastic arm being held in an axial direction perpendicular to the plane of the movement in the bezel by the annular holding ring, either the toothed ring or the elastic arm being arranged to be angularly joined to the rotating bezel, and other being arranged to be angularly joined to the case middle; wherein the elastic arm is formed of a flat strip-spring mounted in a cantilever arrangement in the system.

12 Claims, 2 Drawing Sheets

(56) References Cited

FOREIGN PATENT DOCUMENTS

| | | |
|---|---|---|
| DE | 39 10 479 A1 | 10/1990 |
| EP | 0 686 897 A1 | 12/1995 |

OTHER PUBLICATIONS

Combined Chinese Office Action and Search Report dated Sep. 22, 2020, in Chinese Patent Application No. 201910208703.6 (with English translation), 13 pages.

Office Action dated Jul. 15, 2020 in corresponding Korean Patent Application No. 10-2019-0029949 (with English Translation), 12 pages.

* cited by examiner

ANNULAR ROTATING BEZEL SYSTEM COMPRISING AT LEAST ONE ELASTIC ARM

CROSS-REFERENCE TO RELATED APPLICATION

This application claims priority to European Patent Application No. 18162720.9 filed on Mar. 20, 2018, the entire disclosure of which is hereby incorporated herein by reference.

FIELD OF THE INVENTION

The invention concerns an annular rotating bezel system.

The invention also concerns a watch case comprising a middle part and the annular rotating bezel system rotatably mounted on the case middle.

The invention concerns a watch including the watch case. The watch is, for example, a diver's watch, although this is not limiting in the context of the present invention.

BACKGROUND OF THE INVENTION

Known annular rotating bezel systems comprise a rotating bezel, an annular retaining ring, a toothed ring, and an elastic arm whose free end is elastically and radially engaged with the toothed ring. A rotating bezel system of this type is, for example, described in European Patent No 068689761. The elastic arm is angularly integral with the annular ring, which is in turn pressed onto the case middle, and the toothed ring is angularly integral with the rotating bezel. The elastic arm is formed of a wire spring having several segments extending in two planes perpendicular to each other. The presence of such a wire spring in the rotating bezel system thus makes this system relatively bulky, especially in terms of thickness. Further, the wire spring extends over approximately a quarter of the circumference of the bezel with a smaller radius of curvature than the radius of the bezel, thereby also increasing the dimensions of the system in the radial direction of the bezel. Further, another drawback of such an annular rotating bezel system is that it cannot easily be assembled to the case middle, since the ring must first be pressed onto the case middle around a sealing gasket, then the elastic arm must be fixed to the ring, and then the bezel must be assembled. Thus, not only is assembly complex, but disassembly is virtually impossible and is liable to damage the rotating bezel.

SUMMARY OF THE INVENTION

It is thus an object of the invention to provide an annular rotating bezel system having reduced dimensions, but which is simple to assemble and to manufacture, and overcomes the aforementioned drawbacks of the state of the art.

To this end, the invention concerns an annular rotating bezel system, which includes the features mentioned in the independent claim 1.

Specific embodiments of the system are defined in the dependent claims 2 to 10.

A first advantage of the present invention is that it allows the thickness and diameter dimensions of the system to be reduced. Indeed, the elastic arm is formed of a flat strip-spring mounted in a cantilever arrangement in the system. Such a flat strip-spring occupies less space in the system, and is thinner than a wire spring, thereby saving space in the assembly. Further, such a flat strip-spring has good elastic properties, ensuring the reliability of the rotating bezel system. Moreover, such an arrangement is simple to assemble and to manufacture, since the annular rotating bezel system is made independent of the watch case.

Finally, this arrangement allows a material to be chosen for the toothed ring independently of the material used for the rotating bezel. This makes it possible, for example, to make bezels from precious material with no risk of premature wear since the toothed ring is not integrated in the bezel but is simply secured to said bezel.

Advantageously, the rotating bezel includes at least one lug extending over an inner lateral surface of the bezel, and the elastic arm has, at its other end, on a surface located on the opposite side to the toothed ring, a hollow, in which the bezel lug is engaged, to allow a rotating connection between the elastic arm and the rotating bezel. This means the elastic arm can be easily rotatably connected to the rotating bezel, while facilitating the positioning of the elastic arm in the bezel.

According to a first embodiment of the invention, the annular rotating bezel system includes three elastic arms distributed over 360°, the three elastic arms being spaced apart from each other by 120°. This first embodiment of the invention ensures a good distribution of the bending torque and elastic holding torque over the toothed ring.

According to a second embodiment of the invention, the annular rotating bezel system has only one elastic arm.

Advantageously, the toothed ring has, on an inner edge, at least one lug intended to be received in a hollow arranged in an external cylindrical surface of the case middle. This allows easy angular joining of the toothed ring to the case middle, while facilitating the positioning of the toothed ring on the case middle and allowing the rotating bezel system to be guided for assembly on the case middle.

Advantageously, the annular rotating bezel system consists of on an independent module, said module being configured to be clipped onto the case middle. This provides a simple, practical means of mounting the rotating bezel system on the case middle, and also allows easy disassembly. This makes it possible to further simplify the mounting and method for manufacturing the watch case. The clip mounting system used forms a free hooking system.

To this end, the invention also concerns a watch case including the annular rotating bezel system described above, and which includes the features mentioned in the dependent claim 11.

To this end, the invention also concerns a watch including the watch case described above.

BRIEF DESCRIPTION OF THE DRAWINGS

The objects, advantages and features of the annular rotating bezel system according to the invention will appear more clearly in the following description, based on at least one non-limiting embodiment illustrated by the drawings, in which.

DETAILED DESCRIPTION OF THE INVENTION

Figure 1:
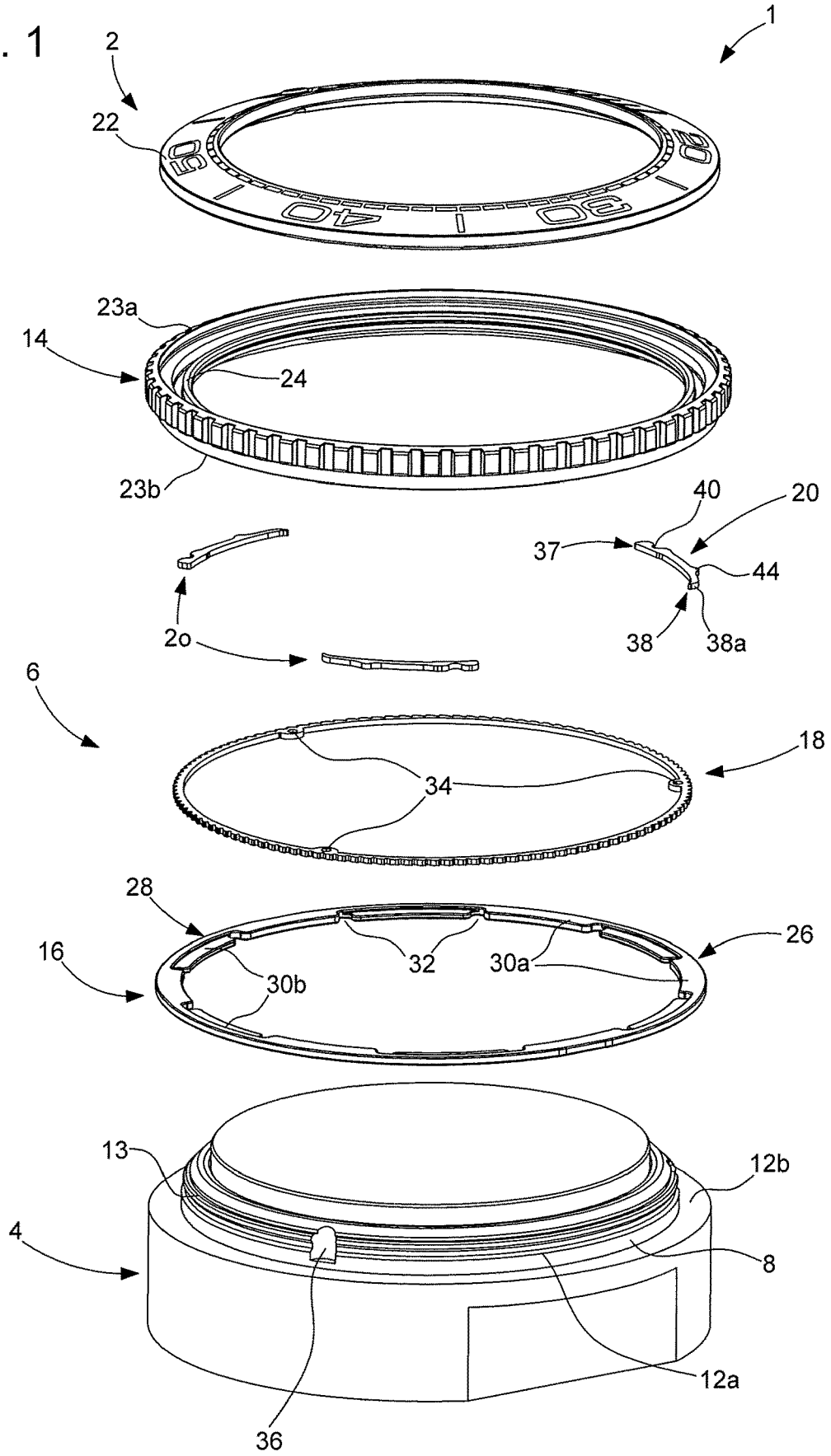
FIG. 1 is an exploded perspective view of an annular rotating bezel system according to a first embodiment of the invention, comprising three elastic arms.
Figure 3:
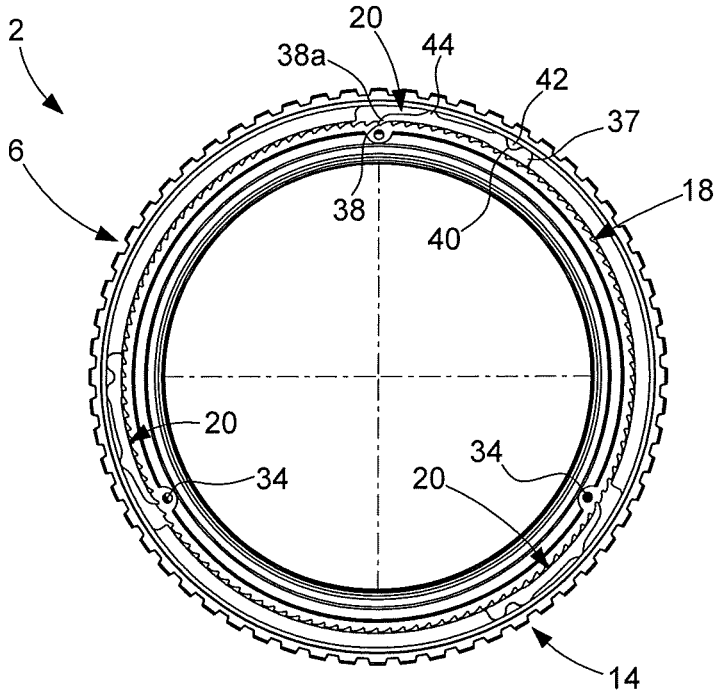
FIG. 3 is a bottom view of the annular rotating bezel system of FIG. 1.
Figure 4:
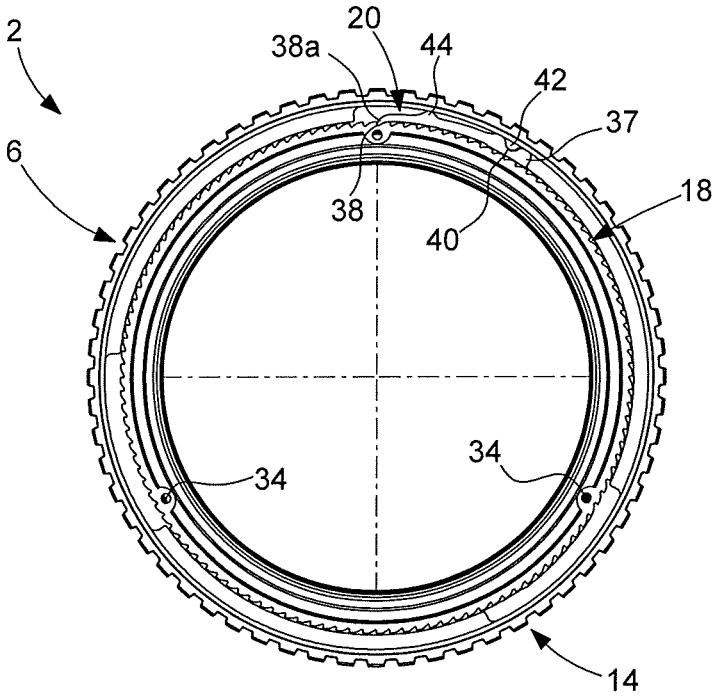
FIG. 4 is a bottom view of an annular rotating bezel system according to a second embodiment of the invention.

FIG. 1 represents a watch 1 provided with a watch case 2. Watch case 2 typically includes a case middle 4. Watch case 2 also includes an annular rotating bezel system 6 and a timepiece movement that extends in a plane, the timepiece movement being omitted from the Figures for reasons of clarity. The annular rotating bezel system 6 is rotatably mounted on case middle 4. Preferably, as illustrated in FIGS. 1, 3 and 4, annular rotating bezel system 6 consists of an independent module. Annular rotating bezel system 6 is, for example, clipped onto case middle 4, as will be detailed hereinafter.

As illustrated in FIG. 1, case middle 4 is of annular shape. Case middle 4 includes an external cylindrical surface 8. As seen in FIG. 1, external cylindrical surface 8 is provided with a peripheral shoulder defined by a lateral wall 12*a* and a base 12*b*. This peripheral shoulder serves as a housing for rotating bezel system 6. Lateral wall 12*a* includes an annular protrusion or bulge 13 extending over the entire perimeter of lateral wall 12*a* and allowing rotating bezel system 6 to be hooked onto case middle 4 in a clip mount. Annular rotating bezel system 6 rests on base 12*b*. Rotating bezel system 6 is thus mounted on case middle 4, from the top of the latter, thereby blocking system 6 in an axial direction perpendicular to the plane of the timepiece movement, while allowing rotation of the bezel around case middle 4. In the watch case 2 taken as an example in FIGS. 1, 3 and 4, the configuration of the watch case is substantially circular. However, the invention is not limited to this watch case configuration, or to the other arrangements described above for case middle 4. The case middle may be made of metal, typically steel, titanium, gold, platinum or ceramic, typically made from alumina, zirconia or silicon nitride.

Figure 2:
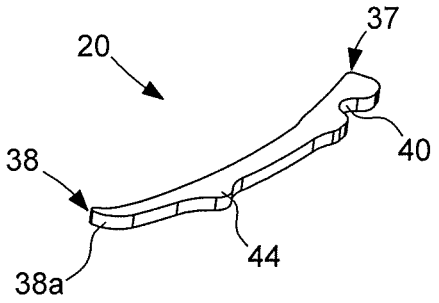
FIG. 2 is a perspective view of one of the elastic arms of the annular rotating bezel system of FIG. 1.

Annular rotating bezel system 6 includes a rotating bezel 14, an annular holding ring 16, a toothed ring 18 and at least one elastic arm 20. A first embodiment of the invention is represented in FIGS. 1 to 3. In this first embodiment, annular rotating bezel system 6 includes three elastic arms 20 distributed over 360°, the three elastic arms 20 being spaced apart from each other by 120°.

Preferably, system 6 further includes a decorative ring 22 press fitted onto rotating bezel 14. Decorative ring 22 bears, for example, graduations, typically diving graduations in the case of a diver's watch 1. Decorative ring 22 is for example made of ceramic.

Rotating bezel 14 is of annular shape and includes an upper surface 23*a* visible to the user and a lower surface 23*b*. As illustrated in FIG. 1, rotating bezel 14 is, for example, provided with an annular rim 24 on an inner edge. Annular rim 24 engages in a clip fit with protrusion 13 of case middle 4, and forms therewith a free hooking system. Rotating bezel 14 is, for example, made of metal but could be made of any other material, for example, of ceramic.

Annular ring 16 holds toothed ring 18 and elastic arms 20 in bezel 14, in an axial direction perpendicular to the plane of the timepiece movement. This facilitates the mounting of rotating bezel 14 on case middle 4. Preferably, annular ring 16 is pressed into rotating bezel 14, securing it thereto. In a variant not represented in the Figures, annular ring 16 is secured to case middle 4.

Annular ring 16 rests on base 12*b* of case middle 4, and thus surrounds external cylindrical surface 8 of case middle 4. Annular ring 16 is configured to cooperate with external cylindrical surface 8 to allow rotation of rotating bezel 14 on case middle 4. Annular holding ring 16 is, for example, a flat ring.

According to a particular variant illustrated in FIG. 1, annular ring 16 includes means 26 for guiding rotating bezel 14 in rotation around case middle 4 and means 28 configured to brake the rotation of rotating bezel 14 around case middle 4 and to dampen sound. In this variant illustrated in FIG. 1, annular ring 16 is, for example, formed of a single piece of material consisting of a plastic material, especially PTFE, ethylene tetrafluoroethylene (Tefzel®), and polyoxymethylene (Delrin®), where necessary coated with a layer intended to improve the friction coefficient. Annular ring 16 is, for example, of rectangular cross-section.

Preferably, as represented in FIG. 1, annular ring 16 includes, on an inner edge, an alternation of tongues 30*a* of a first group of tongues, and tongues 30*b* of a second group of tongues. Tongues 30*a* of the first group and tongues 30*b* of the second group are in contact with external cylindrical surface 8 of case middle 4. Such tongues 30*a*, 30*b* limit the passage dirt into rotating bezel system 6. In the variant not represented in the Figures, wherein annular ring 16 is integral with case middle 4, tongues 30*a* of the first group and tongues 30*b* of the second group are arranged on an external edge of annular ring 16 and are in contact with an inner surface of rotating bezel 14.

In the example embodiment of FIG. 1, the first and second groups of tongues each include six tongues 30*a*, 30*b*, distributed over the inner edge of ring 16 over 360°. The tongues of the same group of tongues are thus spaced apart by 60° two-by-two, tongues 30*a*, 30*b* of the first and second groups of tongues being alternated.

Tongues 30*a* of the first group and tongues 30*b* of the second group have different dimensions in the radial direction. In the example embodiment of FIG. 1, tongues 30*a* of the first group of tongues have smaller dimensions in the radial direction than those of tongues 30*b* of the second group of tongues, and form rotational guiding means 26.

Tongues 30*b* of the second group of tongues form braking and sound dampening means 28. More precisely, tongues 30*b* of the second group of tongues are formed of more flexible segments than tongues 30*a* of the first group. These segments are able to bend in an axial direction perpendicular to the plane of the timepiece movement. To achieve this, a specific example embodiment represented in FIG. 1 consists in that tongues 30*a* of the first group and tongues 30*b* of the second group have different thicknesses, the thickness being measured in the axial direction perpendicular to the plane of the timepiece movement. Typically, tongues 30*b* of the second group have a smaller thickness than that of tongues 30*a* of the first group, thereby giving them greater flexibility. Due to the axial flexibility of tongues 30*b* of the second group, said tongues can brake the rotation of rotating bezel 14 about case middle 4 by friction against external cylindrical surface 8, and also dampen the sound produced.

Braking the rotation of bezel 14 via means 28 has the advantage of smoothing the different plays inside the system so that the user of the bezel does not feel them, and of controlling the rotational torque of the bezel by softening it. Further, braking and sound dampening means 28 reduce the noise produced by rotation of the bezel and thus improve user experience.

Preferably, tongues 30*a*, 30*b* of the first and second groups are separated from each other by hollows 32. This improves, in particular, the flexibility of tongues 30*b* of the second group of tongues.

Preferably too, as seen in FIG. 1, tongues 30*a*, 30*b* of the first and second groups of tongues extend angularly over a substantially equal angular sector.

Evidently, in other variants of the invention, the annular holding ring may comprise a single annular ring of rectangular cross-section over its entire circumference pressed into bezel 14.

Toothed ring 18 includes several teeth, for example 120 teeth, also distributed over 360° on its external edge. Preferably, toothed ring 18 also has, on its inner edge, at least one lug 34 received in a hollow 36 provided in external cylindrical surface 8 of case middle 4. In the example embodiments illustrated in FIGS. 1, 3 and 4, toothed ring 18 includes three lugs 34 distributed over 360° and spaced apart by 120°. External cylindrical surface 8 of case middle 4 has three corresponding hollows 36. This system of lugs 34/hollows 36 allows easy angular joining of toothed ring 18 to case middle 4, while felicitating the positioning of toothed ring 18 on case middle 4. This system also allows rotating bezel system 6 to be guided for mounting on case middle 4. Thus, pressing from the top of system 6 causes lugs 34 to engage in hollows 36, locking the elements inside system 6 and clipping system 6 onto case middle 4.

Toothed ring 18 is formed of a single piece of material. Toothed ring 18 is formed, for example, of a metal alloy, especially a cobalt based alloy (40% Co, 20% Cr, 16% Ni and 7% Mo) commercially known as phynox or steel, typically a stainless steel such as 316L steel. In a variant, toothed ring 18 may be formed of a thermoplastic material, particularly a heat-stable, semi-crystalline thermoplastic material, such as, for example polyarylamide (Ixef®), polyetheretherketone (PEEK) or made of a ceramic material such as zirconia or alumina.

Each elastic arm 20 has a fixed end 37 and a radially and elastically free end 38 in mesh with toothed ring 18. Each elastic arm 20 is formed of a flat strip-spring, flat strip springs 20 extending around toothed ring 18, in substantially the same plane as the plane defined by said ring. Flat strip-springs 20 are arranged such that a longitudinal face of each flat strip-spring 20 extends opposite each toothed ring 18. Each flat strip-spring 20 is mounted in a cantilever arrangement in annular rotating bezel system 6. To achieve this, according to a particular example embodiment illustrated in FIGS. 1 to 3, the fixed end 37 of each elastic arm 20 is angularly joined to rotating bezel 14, while the opposite free end 38 takes the form of a beak 38*a* forming a tooth cooperating with the toothing of toothed ring 18. More precisely, each elastic arm 20 has, on the side of its fixed end 37 on a face located on the side opposite to toothed ring 18, a hollow 40 in which a lug 42 of bezel 14 is engaged. In the example embodiment illustrated in FIG. 3, rotating bezel 14 includes, on an inner lateral face, three lugs 42 distributed over 360° and spaced apart from each other by 120°. This system of lugs 42/hollows 40 allows elastic arms 20 to be easily rotatably connected to rotating bezel 14, while facilitating the positioning of arms 20 in bezel 14.

In this configuration, flat strip-springs 20 are mounted to be flexible in a cantilevered arrangement in annular rotating bezel system 6.

Preferably, and as seen in FIGS. 1 to 3, each elastic arm 20 has, on a face located on the side opposite to toothed ring 18, a boss 44. Each boss 44 rests against an inner lateral face of bezel 14. The spring is arranged to bend between its free end in mesh with the tooth and the boss. The location of this boss thus determines the desired return force of the spring. This boss is arranged on the spring in this example, but could also, according to a variant (not represented), be arranged on the bezel.

Again preferably, each elastic arm 20 has an arched shape whose centre of curvature is located inside bezel 14. Further, the free end 38 of each elastic arm 20 is preferably bent towards the centre of rotating bezel 14 terminating in beak 38*a*. In other words, the free end 38 of each elastic arm 20 has an accentuated curvature compared to the rest of arm 20, i.e. the radius of curvature of free end 38 is smaller than the radius of curvature of the rest of arm 20.

In this manner, the free ends 38 of elastic arms 20 cooperate elastically via beak 38*a* with toothed ring 18. In this configuration, each free end 38 of an arm 20 is in contact with the toothed ring so that there is a rest position in which the beak 38*a* of each free arm 38 is in a hollow between two teeth of toothed ring 18. When the user takes hold of bezel 14 and imparts thereto a rotational torque higher than a certain spring torque determined by elastic arms 20, elastic arms 20 deform and move radially closer to rotating bezel 14, allowing beaks 38*a* of free ends 38 of arms 20 to be released from the hollows of toothed ring 18 and to re-engage in an adjacent tooth of toothed ring 18. Bezel 14 then actually rotates by a corresponding angular sector into a new position. This movement is possible in only one predefined direction: clockwise or anticlockwise, depending on the orientation of elastic arms 20 relative to toothed ring 18. The bezel in this system according to the invention is thus a unidirectional bezel. The direction of rotation of the bezel can, however, be changed by changing the orientation of elastic arms 20 relative to toothed ring 18.

Each flat strip-spring 20 is formed of a single piece of material. Each flat strip-spring 20 is, for example formed of a metal alloy having good spring properties, i.e. which deforms elastically easily while being able to deform significantly without undergoing Plastic deformation, especially Phynox® or amorphous metal alloys. Of course, each flat strip-spring 20 can also, in a variant, be made from a synthetic material.

According to a particular example embodiment, each flat strip-spring 20 is fabricated by a LIGA-process (from the German Röntgenlithographie, Galvanoformung, Abformung).

A second embodiment of the invention will now be described with reference to FIG. 4. According to this second embodiment, annular rotating bezel system 6 has only one elastic arm 20. The features of elastic arm 20 illustrated in FIG. 4 are identical to the features of the other arms 20 illustrated in FIGS. 1 to 3 and described with reference to the first embodiment of the invention. Of course, variants with more than three elastic arms preferably also arranged at the periphery of the bezel may also be envisaged.

The preceding description of the annular rotating bezel system was given with reference to a toothed ring angularly integral with the case middle, and to elastic arms angularly integral with the rotating bezel. However, those skilled in the art will understand that the reverse configuration is possible without departing from the scope of the present invention, i.e. the toothed ring may be angularly integral with the rotating bezel, and the or each elastic arm angularly integral with the case middle.

The invention claimed is:

1. An annular rotating bezel system intended to be rotatably mounted on a middle part of a watch case inside which is housed a timepiece movement which extends in a plane, comprising:

a rotating bezel;

an annular holding ring;

a toothed ring; and at least one elastic arm of which a free end is elastically and radially meshed with the toothed ring, wherein said toothed ring and said at least one elastic arm are held in an axial direction perpendicular to the plane of the movement in the bezel by the annular holding ring, wherein either the toothed ring or the elastic arm being arranged to be angularly joined to the rotating bezel, and other being arranged to be angularly joined to the case middle, wherein the elastic arm is formed of a flat strip-spring mounted in a cantilever arrangement in the system, and wherein the elastic arm has, on a face located on an opposite side to the toothed ring, a boss, said boss resting against an inner lateral face of the bezel.

2. The annular rotating bezel system according to claim 1, wherein the rotating bezel comprises at least one lug extending over an inner lateral surface of the bezel, and wherein the elastic arm has, on the side of its other end on a surface located on the opposite side to the toothed ring, a hollow wherein the lug of the bezel is engaged, to allow a rotating connection between the elastic arm and the rotating bezel.

3. The annular rotating bezel system according to claim 1, wherein the elastic arm has an arched shape whose centre of curvature is located inside the bezel.

4. The annular rotating bezel system according to claim 3, wherein the free end of the elastic arm has a curved shape towards the centre of the bezel.

5. The annular rotating bezel system according to claim 1, wherein the flat strip-spring is formed of a single piece of material comprising a crystalline or amorphous metal alloy.

6. The annular rotating bezel system according to claim 1, wherein the flat strip-spring is fabricated by a LIGA process.

7. The annular rotating bezel system according to claim 1, wherein the system comprises three elastic arms distributed over 360°, the three elastic arms being spaced apart from each other by 120°.

8. The annular rotating bezel system according to claim 1, wherein the toothed ring has, on an inner edge, at least one lug intended to be received in a hollow provided in an external cylindrical surface of the case middle, to allow angular joining of the toothed ring to the case middle.

9. The annular rotating bezel system according to claim 1, wherein said system is formed of an independent module, said module being configured to be clipped onto the case middle.

10. A watch case comprising:

a case middle; and a system provided with an annular rotating bezel rotatably mounted on the case middle, wherein the annular rotating bezel system includes a rotating bezel, an annular holding ring, a toothed ring, and at least one elastic arm of which a free end is elastically and radially meshed with the toothed ring, wherein said toothed ring and said at least one elastic arm are held in an axial direction perpendicular to the plane of the movement in the bezel by the annular holding ring, either the toothed ring or the elastic arm being arranged to be angularly joined to the rotating bezel, and other being arranged to be angularly joined to the case middle, wherein the elastic arm is formed of a flat strip-spring mounted in a cantilever arrangement in the system, and wherein the elastic arm has, on a face located on an opposite side to the toothed ring, a boss, said boss resting against an inner lateral face of the bezel.

11. The watch case according to claim 10, wherein the rotating bezel system includes an independent module configured to be clipped onto the case middle, wherein the case middle includes an external cylindrical surface provided with a peripheral shoulder, the peripheral shoulder including, on a lateral face, an annular protrusion, and wherein the rotating bezel is provided on an inner edge with an annular rim, said annular rim cooperating with said annular protrusion in a clip mount and forming a free hooking system.

12. The watch case according to claim 10, wherein the toothed ring is angularly joined to the case middle, and the other end of the elastic arm is angularly joined to the rotating bezel.

* * * * *